United States Patent [19]

Bokmiller et al.

[11] Patent Number: 4,640,638

[45] Date of Patent: Feb. 3, 1987

[54] CLEANING SYSTEM

[75] Inventors: David J. Bokmiller; Samuel C. Heck, both of San Antonio, Tex.

[73] Assignee: Sani-Fresh International, Inc., San Antonio, Tex.

[21] Appl. No.: 592,945

[22] Filed: Mar. 23, 1984

Related U.S. Application Data

[63] Continuation-in-part of Ser. No. 478,516, Mar. 24, 1983, Pat. No. 4,534,669.

[51] Int. Cl.[4] ..... A46B 11/02; A47L 13/22; A47L 13/17

[52] U.S. Cl. ..... 401/145; 401/146; 401/156; 401/158; 401/160; 222/207; 222/209; 222/325; 239/327

[58] Field of Search ..... 401/143, 146, 149, 153, 401/151, 145, 156, 158, 160, 163, 165, 166, 167; 222/207, 209, 325; 239/327

[56] References Cited

U.S. PATENT DOCUMENTS

| | | | |
|---|---|---|---|
| 1,392,396 | 10/1921 | Stoewsand | 401/150 |
| 1,600,095 | 9/1926 | Casaclang | 401/165 |
| 1,677,194 | 7/1928 | Mendoza . | |
| 1,968,891 | 8/1934 | Johnson . | |
| 2,109,589 | 3/1938 | Horwitt et al. | 222/325 X |
| 2,229,161 | 1/1941 | Adams . | |
| 2,554,570 | 5/1951 | Harvey . | |
| 2,629,516 | 2/1953 | Badham . | |
| 2,644,613 | 7/1953 | Pepin | 401/166 X |
| 2,770,828 | 11/1956 | Ellman . | |
| 2,772,430 | 12/1956 | Moritt | 401/151 |
| 2,785,425 | 3/1957 | Lenk . | |
| 2,795,000 | 6/1957 | Lomholdt . | |
| 3,089,465 | 5/1963 | West | 401/160 |
| 3,116,855 | 1/1964 | Thomson . | |
| 3,118,166 | 1/1964 | Bell | 401/150 X |
| 3,197,800 | 8/1965 | Karkut . | |
| 3,618,829 | 11/1971 | Elmore | 222/209 |
| 3,723,015 | 3/1973 | Wissler et al. . | |
| 3,828,985 | 8/1974 | Schindler | 222/207 |
| 3,864,047 | 2/1975 | Sherrod . | |
| 3,938,897 | 2/1976 | Craig . | |
| 3,973,700 | 8/1976 | Schmidt et al. . | |
| 3,986,644 | 10/1976 | Grogan et al. . | |
| 3,995,774 | 12/1976 | Cooprider et al. . | |
| 4,018,363 | 4/1977 | Cassia . | |
| 4,098,434 | 7/1978 | Uhlig | 222/209 X |
| 4,101,057 | 7/1978 | LoMaglio . | |
| 4,102,476 | 7/1978 | Loeffler | 239/237 X |
| 4,122,980 | 10/1978 | Laverty | 222/207 |
| 4,140,410 | 2/1979 | Garcia . | |
| 4,167,349 | 9/1979 | Testa . | |
| 4,217,671 | 8/1980 | Rand . | |
| 4,260,079 | 4/1981 | Cary et al. | 222/209 |
| 4,336,895 | 6/1982 | Aleff | 222/383 X |
| 4,347,953 | 9/1982 | Bauer | 222/207 |
| 4,349,133 | 9/1982 | Christine . | |
| 4,394,938 | 7/1983 | Frassanito . | |
| 4,457,454 | 7/1984 | Meshberg | 222/209 X |
| 4,489,857 | 12/1984 | Batlas | 222/325 X |
| 4,489,861 | 12/1984 | Saito et al. | 222/207 |

FOREIGN PATENT DOCUMENTS

| | | |
|---|---|---|
| 1278449 | 4/1962 | France . |
| 786526 | 11/1957 | United Kingdom . |

*Primary Examiner*—Steven A. Bratlie
*Attorney, Agent, or Firm*—Sisson & Smith

[57] ABSTRACT

A cleaning system (60) includes an elongate handle (61) having a surface cleaning means (65) disposed at one end of the handle and a cleaning fluid cartridge means (64) disposed at the other end of the handle. The cleaning system further includes a means for pumping (66) the cleaning fluid from the fluid cartridge means to the surface cleaning means, and the pump means (66) is associated with the cleaning fluid cartridge means.

5 Claims, 10 Drawing Figures

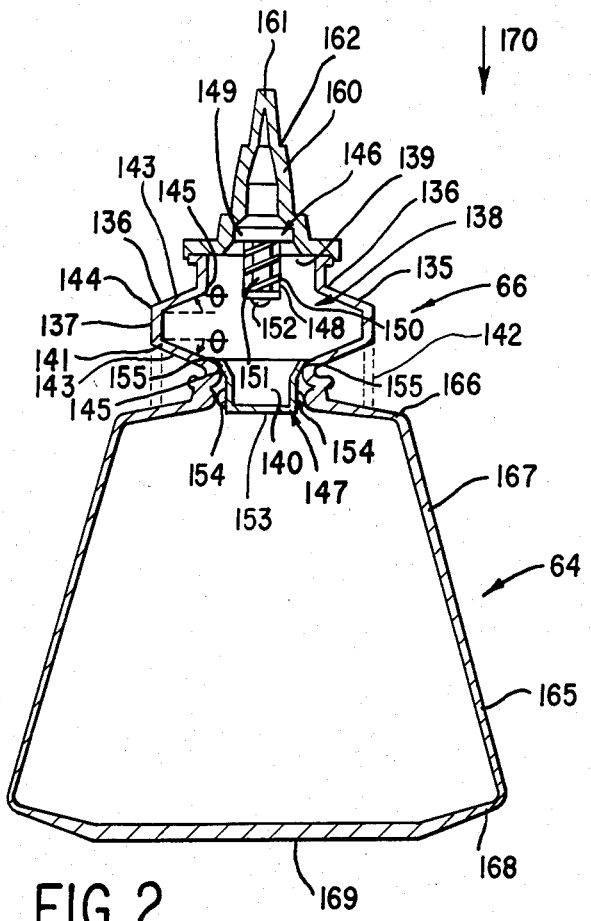
FIG. 2
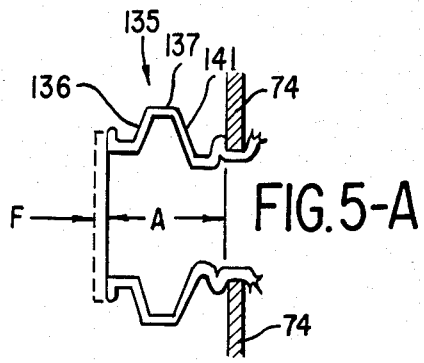
FIG. 5-A
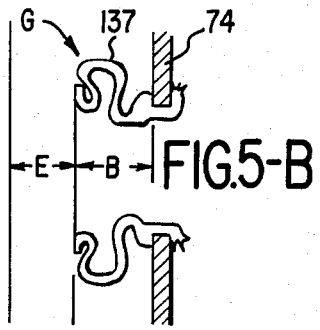
FIG. 5-B
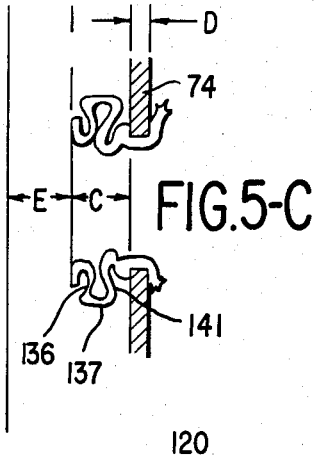
FIG. 5-C
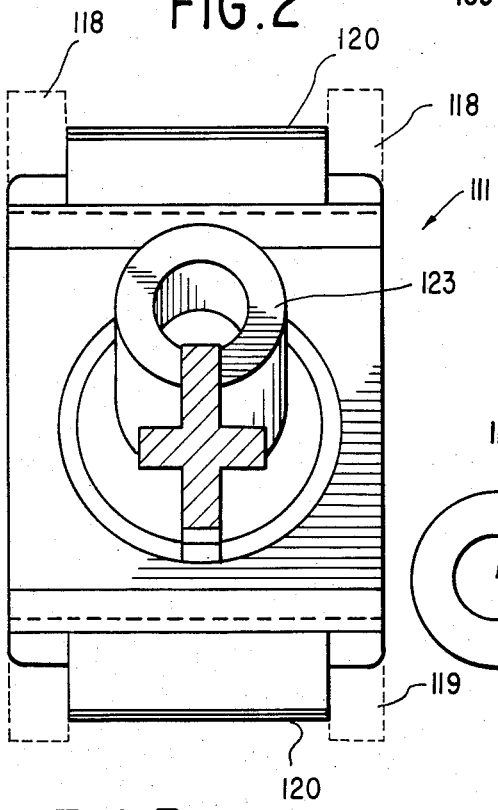
FIG. 3
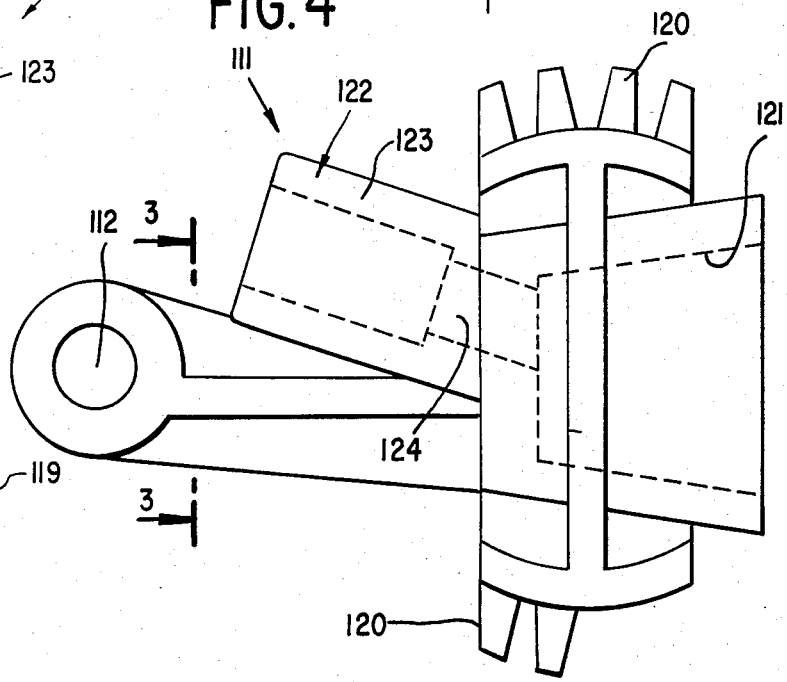
FIG. 4

CLEANING SYSTEM

The present application is a continuation-in-part of U.S. Patent Application Ser. No. 478,516 filed Mar. 24, 1983 now U.S. Pat. No. 4,534,669.

FIELD OF THE INVENTION

The invention relates to a cleaning system, particularly for use in cleaning bathrooms and bathroom plumbing fixtures.

DESCRIPTION OF THE PRIOR ART

Typically bathroom fixtures such as conventional commodes, or water closets, found in the home, or wall-mounted urinals found in such places as commercial building bathrooms, are cleaned with a short handled brush or sponge and a conventional scouring powder contained in a can or with a liquid cleaner which is poured or sprayed from a bottle. Cleaning such plumbing fixtures with the foregoing described brush is an arduous and awkward task.

One attempt to alleviate the inherent problems encountered in cleaning bathroom fixtures is disclosed in U.S. Pat. No. 4,217,671 issued to Rand on Aug. 19, 1980. This patent discloses an electrically powered cleaning device wherein a plurality of different shaped scrubber heads are rotated by an electrical motor, and a gravity operated detergent dispenser is associated with the device. The apparent disadvantages with this cleaning device are that many restrooms may not have an electrical outlet conveniently located with respect to the commode, or water closet, to be cleaned; as well as the inherent, potential danger associated from operating an electrical device, a portion of which is immersed in water. Another, apparent disadvantage would be that the weight of such a device could easily cause muscle strain for the worker utilizing such a device to clean commodes, or water closets, and/or wall mounted urinals. A further apparent disadvantage of this device would appear to be the expense of manufacturing such a device, particularly when an electrical motor must be included therewith. Additionally, there would appear to be another safety hazard in that detergent could drop onto the rotating brush and be flung into an operator's eye, or alternatively, such material could riccochet from the rotating brush to the bathroom fixture and into the operator's eye.

Accordingly, prior to the development of the present invention, there has been no cleaning device or system particularly adapted to cleaning bathroom plumbing fixtures which is simple and economical to manufacture, safe to operate and use, and prevents muscle strain to the operator of the system. Therefore, the art has sought a cleaning system for bathroom plumbing fixtures which is simple and economical to manufacture, is easily and safely used and seeks to eliminate muscle strain and other inherent problems encountered when cleaning bathroom plumbing fixtures.

SUMMARY OF THE INVENTION

In accordance with the invention the foregoing advantages have been achieved through the present cleaning system. The present invention includes an elongate handle having first and second ends and a cleaning fluid cartridge means adapted to contain a cleaning fluid; the handle includes a surface cleaning means disposed at the first end, the cleaning fluid cartridge means being disposed at the second end, a means for pumping the cleaning fluid from the fluid cartridge means to the surface cleaning means, said pump means being associated with the cleaning fluid cartridge means, and a pump actuation means associated with the pump means and the handle. A feature of the present invention is that the cleaning fluid cartridge means may be removeably attached to the handle. A further feature of the present invention is that the surface cleaning means may be a mop head disposed on the first end of the handle, the mop head including a fluid passageway to allow the cleaning fluid to be pumped through, and outwardly of, the mop head to a surface to be cleaned.

An additional feature of the present invention is that the handle may include means for supporting the fluid cartridge means, including a housing associated with the handle and the housing has a moveable door allowing access to the interior of the housing. Another feature of the present invention is that a safety switch means may be associated with the handle, which safety switch means has: a first loading position wherein the pump actuation means is not operable and the housing door is moveable to allow the cleaning fluid cartridge means to be inserted within the housing; a second locked position wherein the pump actuation means is not operable and the housing door is not moveable; and a third operating position wherein the pump actuation means is operable and the housing door is not moveable.

Further, in accordance with the present invention, the pump means may comprise a pump chamber defined by an upper wall and a flexible side wall interconnecting the upper wall to the cleaning fluid cartridge means, with a fluid pasageway having first and second ends passing through the pump chamber in fluid communication between the cleaning fluid cartridge means and the handle, whereby upon movement of the pump actuation means, cleaning fluid is pumped from the cleaning fluid cartridge means into the handle. An additional feature of the present invention is that the pump means may comprise a pump chamber defined by upper and lower end walls and a flexible side wall interconnecting the upper and lower end walls, wherein a fluid passageway having first and second ends passes through the pump chamber in fluid communication between the cleaning fluid cartridge means and the handle, whereby upon movement of the pump actuation means, cleaning fluid is pumped from the cleaning fluid cartridge means into the handle. The foregoing upper and lower end walls of the pump chamber, in accordance with the present invention, may each comprise an annular disk having an outer diameter and an inner diameter; each annular disk having a truncated cone configuration wherein each disk tapers upwardly at an acute angle from the outer diameter to the inner diameter.

A further feature of the present invention is that the cleaning system may further include a means for maintaining pumping of cleaning fluid from the cleaning fluid cartridge means after operation of the pump actuation means has ceased to apply a force to the pump means. The means for maintaining pumping, in accordance with the present invention, may include a flexible and expandable pump chamber, which is expanded upon operation of the pump actuation means, and a biased support structure cooperating with the pump chamber, which structure is biased against the force exerted upon the pump chamber by the pump actuation means, whereby after the pump actuation means has expanded the pump chamber and applied a force thereto, the biased support structure exerts a force upon the pump chamber to maintain the pumping of cleaning fluid from the cleaning fluid cartridge means.

The cleaning system of the present invention, when compared with previously proposed prior art cleaning devices has the advantages of being simple and economical to manufacture and use, is safe to manufacture and use (when properly used), and helps to prevent and/or alleviate muscle strain associated with the cleaning of bathroom plumbing fixtures, and other surfaces which need to be cleaned.

BRIEF DESCRIPTION OF THE DRAWINGS

In the drawings:

FIG. 1B being broken off from FIG. 1A as shown by dotted lines;

FIG. 2 is a cross-sectional view of a cleaning fluid cartridge means in accordance with the present invention;

FIG. 3 is a cross-sectional view of a portion of the linkage pumping mechanism taken along line 3—3 of FIG. 4;

FIG. 4 is a side view of a portion of the linkage pumping mechanism; and

FIGS. 5-A, 5-B and 5-C are partial cross-sectional views illustrating the sequential operation of the pump means and means for maintaining pumping of cleaning fluid in accordance with the present invention.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

Figure 1:
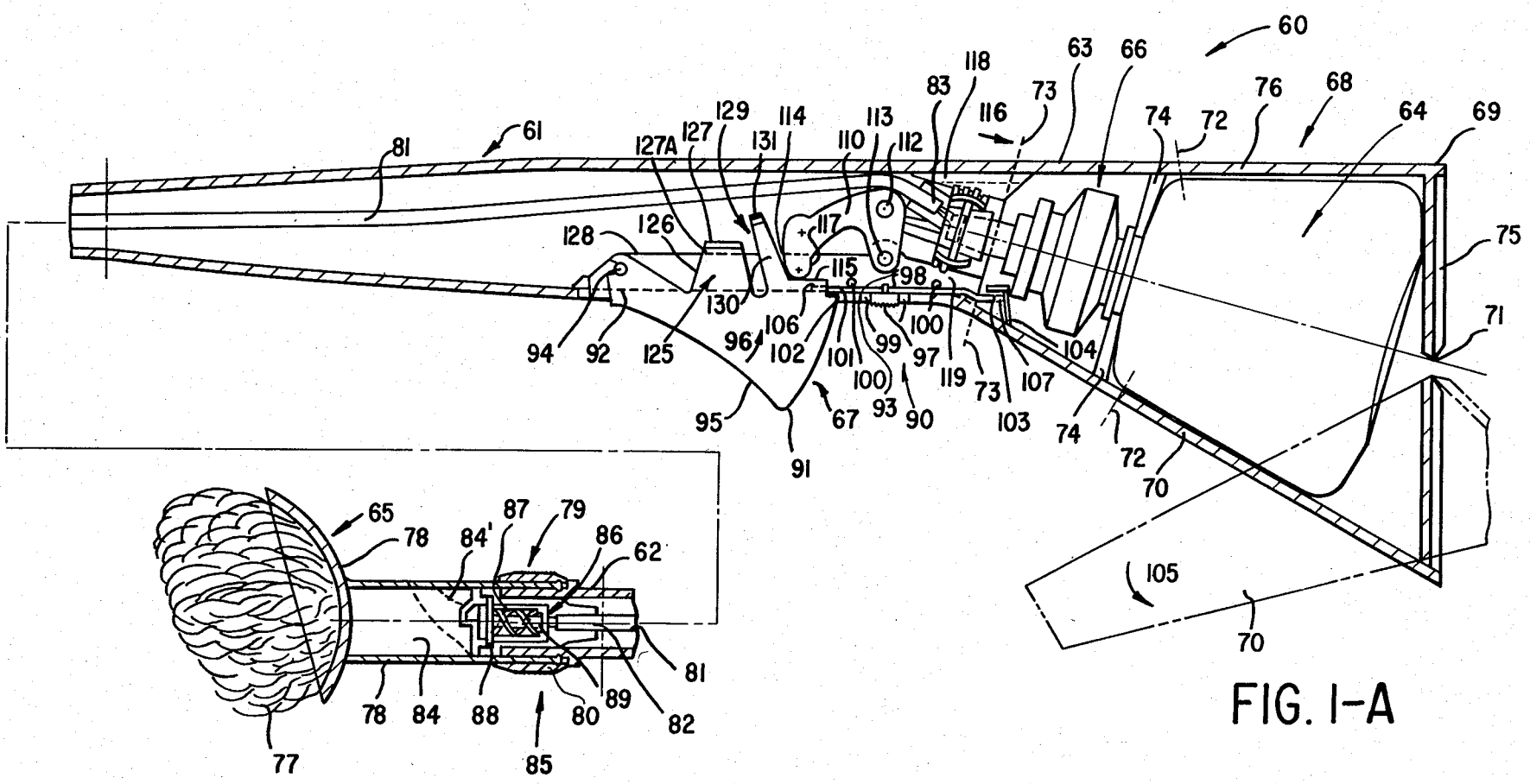
FIGS. 1A and 1B present a partial cross-sectional view along the longitudinal axis of a cleaning system in accordance with the present invention.

In FIGS. 1-A, 1-B and 7, a cleaning system 60, in accordance with the present invention, is shown to generally comprise an elongate handle 61 having first and second ends, 62 and 63, and a cleaning fluid cartridge means 64 disposed at the second end 63 and adapted to contain a cleaning fluid, as will be hereinafter described. Handle 61 preferably includes a surface cleaning means 65 disposed at the first end 62 of handle 61, which surface cleaning means 65 will be hereinafter described in greater detail. Handle 61 further preferably includes a means for pumping 66 the cleaning fluid from the cleaning fluid cartridge means 64 to the surface cleaning means 65; and the pump means 66 is preferably associated with the cleaning fluid cartridge means 64, as will be hereinafter described in greater detail. Further, handle 61 preferably includes a pump actuation means 67 associated with the pump means 66 and handle 61.

Still with reference to FIGS. 1-A and 1-B, the cleaning fluid cartridge means 64 is preferably removeably attached to handle 61, as will be hereinafter described in greater detail. Handle 61 may further include means for supporting 68 the fluid cartridge means 64, which means for supporting 68 preferably includes a housing 69 associated with handle 61. Housing 69 preferably has a moveable door 70 which allows access to the interior of housing 69. Door 70 is illustrated in FIG. 1-A in its closed position in solid lines, and is illustrated in its open position as illustrated by the dotted lines. Door 70 may be pivotably or hingedly attached to housing 69 as at pivot or hinge point 71, in any suitable manner. Handle 61 could terminate at the point shown in FIG. 1-A by dotted lines 72, whereby the fluid cartridge means 64, including pump means 66, could be removeably attached to the handle 61 and supported by the handle 61 and cleaning fluid cartridge means 64 would be exposed. Preferably support means 68 would then comprise the portion of handle 61 disposed between dotted lines 72 and 73, including support walls 74 which will be hereinafter described in greater detail. Preferably, in order to provide for greater support of the cleaning fluid cartridge means 64 and to protect it from damage, support means 68 is comprised of housing 69 which extends from the bottom 75 of housing 69 to the handle 61 at dotted lines 73, and the upper wall 76 of housing 69 is formed integral with handle 61. Preferably, handle 61, housing 69, pump actuation means 67, and/or door 70, are all formed of a suitable plastic material having the requisite strength and corrosion resistant characteristics to withstand the forces exerted upon the cleaning system 60 when used, as well as withstand contact with the cleaning fluid (not shown) utilized in cleaning fluid cartridge means 64. In this regard, any suitable cleaning fluid could be utilized; however, in the case of cleaning bathroom fixtures, it would be desirable to utilize an acid solution as the cleaning fluid.

Still with reference to FIGS. 1-A and 1-B, it is seen that surface cleaning means 65 may comprise a mop head 77 disposed on the first end 62 of handle 61. Mop head 77 could be of any configuration, and made of any material having the requisite properties for rubbing, or scrubbing, against a surface to be cleaned, and having the requisite corrosion resistance properties against deterioration from contact with the cleaning fluid utilized in the cleaning system 60. Alternatively, a suitable brush could be substained for mop head 77, and it should be understood that the term mop head 77 or surface cleaning means 65, encompasses any structure suitable for scrubbing, or rubbing, against a surface to be cleaned. Mop head 77 can be provided with a backing structure 78 which may be permanently or removeably affixed to the first end 62 of handle 61 as by a press-fit or snap connection as shown at 79, via an annular ring 80 which presses backing structure 78 about the first end 62 of handle 61.

Still with reference to FIGS. 1-A and 1-B, it is seen that handle 61 includes a first fluid passageway 81, having first and second ends 82, 83 in fluid communication between the cleaning fluid cartridge means 64 and the first end 62 of handle 61. Fluid passageway 81 may be comprised of a length of tubing of any suitable material compatible with the cleaning fluid. As will be hereinafter described in greater detail, upon operation of pump actuation means 67, cleaning fluid is pumped from cleaning fluid cartridge means 64 via pump means 66 into the first fluid passageway 81. Mop head 77, including its backing structure 78 may be provided with a second fluid passageway 84, or as shown in dotted lines, 84'. Fluid passageways 84 and 84' are in fluid communication with the first fluid passageway 81, whereby cleaning fluid may be pumped through the mop head 77 via second fluid passageway 84 and out of mop head 77. Alternatively, the cleaning fluid may be pumped from first fluid passageway 81 into the second fluid passageway 84' and pumped outwardly thereof to the surface (not shown) which is desired to be cleaned.

With reference to FIG. 1-B, it is seen that a safety means 85 for preventing cleaning fluid from draining from the first fluid passageway 81 is associated with the first end 62 of handle 61. Preferably, safety means 85 comprises a safety check valve 86 disposed proximate the first end 62 of handle 61. Safety check valve 86 may be biased into a first position, as shown in FIG. 1-B to seal the first end 82 of the first fluid passageway 81, which is adjacent the safety check valve 86, in which position the safety check valve 86 prevents transmission of cleaning fluid outwardly of handle 61. Safety check valve 86 further prevents cleaning fluid from draining outwardly of the second end 83 of the first fluid passageway 81, which is disposed proximate the second end 63 of handle 61. Thus, were cleaning fluid cartridge means 64 to be removed from handle 61, the sealing of the first end 82 of fluid passageway 81, in conjunction with surface tension and/or capillary action associated with the cleaning fluid disposed in first fluid passageway 81, would prevent the cleaning fluid from draining from the second end 83 of the first fluid passageway. It should be noted that safety check valve 86 is preferably spring loaded. A plastic helical spring 87 may bias a sealing disk 88, via shaft member 89 affixed to sealing disk 88, against the first end 62 of handle 61. The safety check valve 86 is moveable to a second open position to allow cleaning fluid to be pumped outwardly of the safety check valve 86 upon the cleaning fluid being pumped through the first fluid passageway 81. Thus, upon the fluid pressure of the cleaning fluid disposed within first fluid passageway 81 exceeding the biasing force of the spring 87 of safety check valve 86, sealing disk 88 moves in a direction toward the mop head 77 to allow the cleaning fluid to pass into either second fluid passageway 84 or 84'.

With reference to FIG. 1-A, it is seen that handle 61 may be provided with a safety switch means 90, which has a first locked position wherein the pump actuation means 67 is not operable and a second operating position wherein the pump actuation means 67 may be operated. In this regard, pump actuation means 67 may comprise a moveable member, or trigger member, 91 disposed within a slotted opening 92 in handle 61, which is operatively engageable with pump means 66 to exert a force upon pump means 66. Preferably, trigger member 91 is operatively engageable with the pump means 66 via a moveable linkage 93 to exert a force upon the pump means 66, as will be hereinafter described in greater detail. Trigger member 91 may be pivoted about pivot point 94 disposed within handle 61, and may have a curved lower surface 95 which may be engaged by a human operator grasping handle 61 with at least one finger against surface 95, whereby trigger member 91 may be depressed and pivoted about pivot point 94 in the direction shown by arrow 96.

Still with reference to FIG. 1-A, it is seen that safety switch means 90 may include a button, or switch, member 97 affixed to an elongate engagement member 98. Button member 97 is disposed within a slot 99 formed in handle 61, and is retained within slot 99 in any suitable manner, such as by pins 100 which engage the underside of elongate engagement member 98 to secure engagement member 98 between pins 100 and the interior of housing 61. Safety switch means 90 may further have a first loading position wherein the pump actuation means 67 is not operable and the housing door is moveable to allow the cleaning fluid cartridge means 64 to be inserted within the housing, upon door 70 being opened. A second locked position is provided by safety switch means 90 wherein the pump actuation means 67 is not operable and the housing door 70 is not moveable. Further, safety switch means 90 may be provided with a third operating position wherein the pump actuation means 67 is operable and the housing door 70 is not moveable, whereby trigger member 91 may be depressed, but door 70 may not be opened while cleaning system 60 is being utilized with trigger member 91 being depressed. As shown in FIG. 1-A in solid lines, the elongate engagement member 98 of safety switch means 90 is shown disposed in the second locked position wherein the pump actuation means 67, or trigger member 91, is not operable and the housing door is not moveable. This second locked position corresponds to switch 97 being disposed within the center of slot 99 as illustrated in FIG. 1-A. It should be noted that end 101 of elongate engagement member 98 is disposed over a notch 102 formed in trigger member 91, whereby upon exerting a force on trigger member 91 in the direction shown by arrow 96, notch 102 would abut against end 101 of elongate engagement member 98. The other end 103 of elongate engagement member 98 is shown disposed in an abutting relationship with a stop member 104 provided to door 70 of housing 69. Were an operator to attempt to pivot door 70 downwardly in the direction shown by arrow 105, the end 103 of elongate engagement member 98 would abut against stop means 104, whereby the door could not be opened.

Still with reference to FIG. 1-A, the previously described first loading position of safety switch means 90 would correspond to movement of button, or switch, member 97 to its furthermost position within slot 99 toward trigger member 91, as shown by dotted lines 106. In this first loading position, movement of trigger 91 would once again be prevented by the abutment of notch 102 against end 101 of elongate engagement member 98. The movement of elongate engagement member 98 into the first loading position would cause end 103 of elongate engagement member 98 to move away from stop means 104, whereby the door 70 could be swung open to allow a cleaning fluid cartridge means 64 to either be unloaded from housing 69, or to allow a new cleaning fluid cartridge means 64 to be inserted within housing 69.

When the button member 97 of safety switch means 90 is moved to its furthermost position within slot 99 toward the housing 69, the end 101 of elongate engagement member 98 would not abut against notch 102 in trigger member 91, whereby trigger member 91 could be depressed. In this operating position, end 103 of elongate engagement member 98 would be in a complete abutting relation ship with stop means 104 as shown by dotted lines 107. Thus, while cleaning system 60 is utilized and trigger member 91 is being depressed, an operator would not be able to gain access to the interior of housing 69.

The advantages of having a safety switch means 90, such as the three position slide switch of button, or switch, member 97 and elongate engagement member 98, provides important safety factors, particularly when the cleaning fluid utilized in cleaning fluid cartridge means 64 is an acid type solution. When an operator is either loading or unloading a cleaning fluid cartridge means 64, the pump means 66 cannot be actuated in that movement of trigger member 91 is restrained, thus preventing accidental discharge of cleaning fluid, as described in connection with the first loading position.

When cleaning system 60 has the safety switch means 90 disposed in the second locked position, previously described, an operator may safely carry the cleaning system 60 and accidental movement of trigger member 91 is precluded. Accidental opening of door 70 is likewise prevented, which could result in the cleaning fluid cartridge means 64 falling from housing 69 and possibly splashing on the floor or the operator. Cleaning fluid can only be pumped from the cleaning system 60 when the safety switch means 90 is disposed in the third operating position, at which time accidental opening of door 70 is precluded, as well as movement of cleaning fluid cartridge means 64 from housing 69 is likewise precluded.

Figure 6:
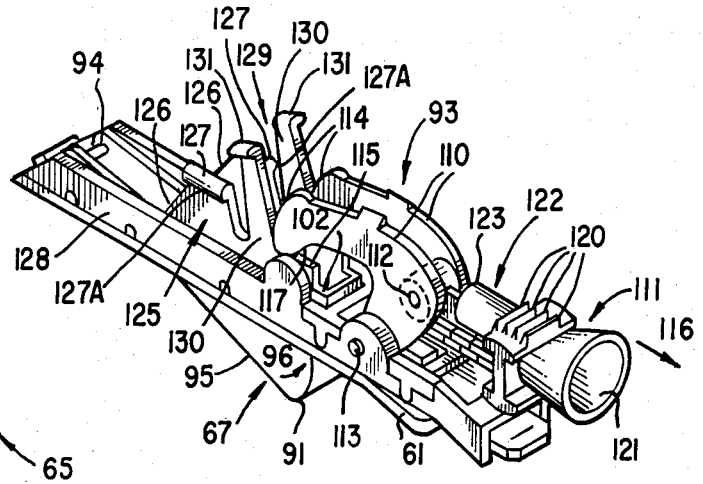
FIG. 6 is a perspective view of the trigger and movable linkage pumping mechanism.
Figure 7:
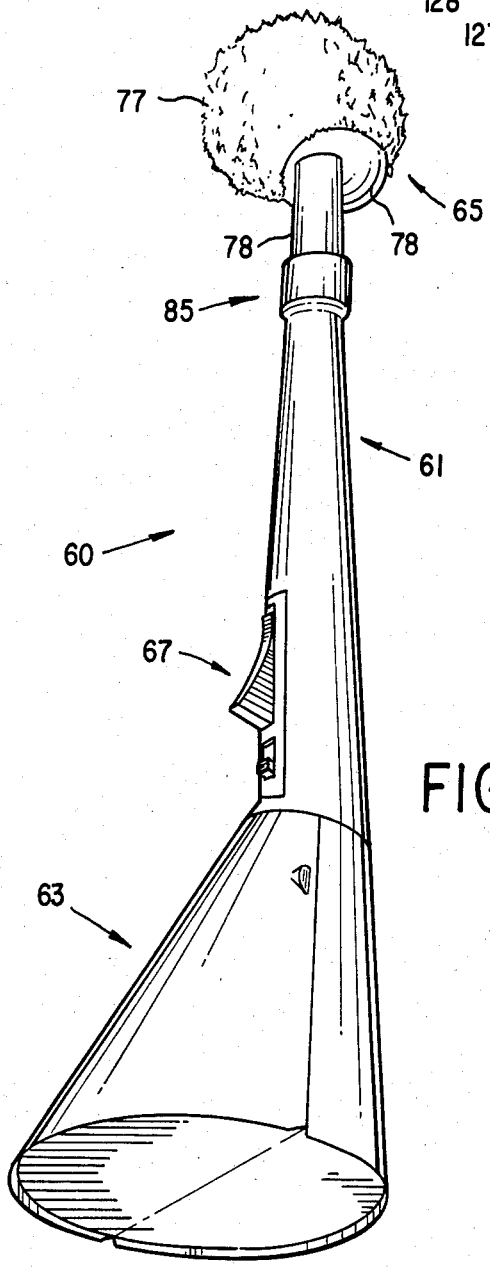
FIG. 7 is a perspective view of a preferred embodiment of the cleaning system.

Still with reference to FIG. 1-A, trigger member 91 preferably has a first operating position wherein a force sufficient to actuate the pump means 66 is generated and transmitted to the pump means 66; a second non-operating position wherein a pre-load force not sufficient to actuate the pump means 66 is generated and transmitted to the pump means 66; and a third non-operating position wherein the pre-load force is relieved to allow a cleaning fluid cartridge means to be disposed at the second end of handle 61. The first operating position of trigger member 91 corresponds to when trigger member 91 has been depressed in the direction shown by arrow 96 whereby moveable linkage 93 has exerted a force upon pump means 66. In this regard, and further with reference to FIGS. 3, 4, and 6, it is seen that moveable linkage 93 may comprise a pivotable swing arm 110 and an end cap member 111, as seen in FIGS. 3, 4 and 6. Swing arm 110 and end cap member 111 have a common pivot point, or shaft, 112, and swing arm 110 is in turn pivoted about shaft 113 associated with housing 61. Swing arm 110 has a camming surface 114 which is in sliding engagement with surfaces 115 of trigger member 91, whereby upon movement of trigger member 91 in the direction shown by arrow 96, camming surface 114 slides on surfaces 115 and swing arm 110 pivots about shaft 113. This in turn causes movement of end cap member 111 in the direction shown by arrow 116 as end cap member 111 pivots about pivot 112. As the trigger member 91 is depressed, tip 117 of camming surface 114 of swing arm 110 will engage notch 102 in trigger member 91 and thus will reach the end of its travel. Preferably, swing arm 110 is comprised of two spaced plate members having the configuration shown in FIG. 1-A and FIG. 6 whereby first fluid passageway 81 may pass through the space between the two plate members (as shown in FIG. 1-A) and not interfere with the movement of swing arm 110.

Still with reference to FIGS. 1-A and FIGS. 3-4, it is seen that the interior of handle 61 may be provided with two sets of spaced track members 118, 119, the track members 118 and 119 appearing in dotted lines in FIG. 3. The movement of end cap member 111 in the direction shown by arrow 116 is thus obtained by the sliding engagement of a plurality of guide members 120 mounted on end cap member 111, being restrained by the track members 118, 119. End cap member 11 may further be provided with a nozzle receiving cavity and pressure transmitting member 121 which engages the pump means 66 of cleaning fluid cartridge means 64 as will be hereinafter described. End cap member 111 further includes a means for receiving 122 the second end 83 of the first fluid passageway 81. Preferably, receiving means 122 is an annular shaped cavity 122 in which the second end 83 of tubing 81 is fixedly secured, and the annular shaped cavity 122 is in fluid comminication with the nozzle receiving cavity 121 as by a passageway 124.

Referring now to FIG. 1-A, it should be noted that trigger member 91 is illustrated in the second non-operating position wherein a pre-load force not sufficient to actuate the pump means 66 is generated and transmitted to the pump means 66 via moveable linkage 93. As shown in FIG. 1-A and 6, trigger member 91 is provided with a means for releasably maintaining 125 the trigger member 91 in the second non-operating position. the means for releasably maintaining 125 trigger member 91 in this position may comprise two spaced, flexible arms 126 each having an outwardly extending lip member 127 which extends outwardly and overlies a rail member 128. lips members 127 may each have a bevelled surface 127A underneath, as will be hereinafter described. In this regard, two spaced rail members 128 are provided, and they may be integral extensions of the track members 119 previously described. Upon abutment of lip members 127 with the rail members 128, downward movement of trigger member 91 is selectively precluded. However, when lip members 127 engage and abut against rail members 128, trigger member 91 is still causing movement of end cap member 111 to a limited degree via the abutment of cam surface 114 of swing arm 110 against surface 115 of trigger member 91. This force, or pre-load force, resulting from the movement of end cap member 111 against pump means 66 is not enough force to actuate the pump means 66, but assists the trigger member 91 to reassume its second non-operating position after the actuation of pump means 66. When trigger member 91 has reached the limit of its upward travel in the direction shown by arrow 96, trigger member 91 is in its first operating position previously described.

Still with reference to FIG. 1-A, upon grasping trigger member 91 and pulling it downwardly with a sufficient force, the flexible arms 126 are forced inwardly by the sliding engagement of bevelled surfaces 127A of lip members 127 against the tops of rail members 128. Releaseable maintaining means 129, for maintaining the trigger member 91 in its third non-operating position may preferably comprise a pair of spaced arm members 130 having outwardly engageable lip members 131 which abut against rail members 128 to prevent trigger member 91 from being pulled completely downwardly out of handle 61. When trigger member 91 has been pulled downwardly until engageable lip members 131 engage rail members 128, the camming surface 114 of swing arm 110 likewise moves downwardly and causes longitudinal movement of end cap member 111 away from pump means 66 to thus allow either a cleaning fluid cartridge means 64, including pump means 66, to be inserted or removed from housing 69. After a new cleaning fluid cartridge means 64 has been inserted within housing 69, trigger member 91 is pushed upwardly in the direction shown by arrow 96 until arm members 126 spring outwardly whereby lip members 127 once again engage rail members 128. Further upward movement of trigger member 91 is precluded by the abutment of notch 102 of trigger member 91 against the elongate engagement member 98, as previously described. It should be noted that pump actuation means 67, including linkage 93 and safety switch 90, could be manufactured as a single unit and then press-fitted into handle 61.

Turning now to FIG. 2, the cleaning fluid cartridge means 64 and pump means 66 of the present invention will be described in greater detail. Pump means 66 may comprise a pump chamber 135 defined by an upper wall 136 and a flexible side wall 137 interconnecting the upper wall 136 to the cleaning fluid cartridge means 64. A fluid passageway 138 having first and second ends 139, 140 passes through the pump chamber 135 in fluid communication between the cleaning fluid cartridge means 64 and to the handle 61, or nozzle receiving cavity 121 of end cap member 111, as shown in FIG. 1-A. Upon movement of the pump actuation means, or trigger member 91, cleaning fluid is pumped from the cleaning fluid cartridge means 64 into the handle 61 as will be hereinafter described in greater detail. Preferably, pump chamber 135 further includes a lower end wall 141, with flexible side wall 137 disposed between upper and lower walls 136, 141. It should be noted that if lower end wall 141 is not utilized, flexible side wall 137 could be extended as shown by dotted lines 142 to connect to the fluid cartridge means 64.

Still with reference to FIG. 2, the upper and lower end walls 136, 141 of pump chamber 135, preferably each comprise an annular disk 143 having an outer diameter 144 and an inner diameter 145. Each annular disk 143 is in a configuration, wherein each disk 143 tapers upwardly at an acute angle from the outer diameter 144 to the inner diameter 145. Preferably, the angle $\phi$ falls within a range of from 10° to 35°, with angles of from 15° to 28° being particularly preferred. The outer diameter of each annular disk 143 is joined to the flexible side walal 137, and as shown in FIG. 2, the inner diameter 145 of one of the annular disks 143 is joined to the cleaning fluid cartridge means 64. If the pump chamber is only comprised of the upper wall 136 and the flexible side wall 137, the outer diameter 144 of upper wall 136 is joined to flexible side wall 137, and the lower end of flexible side wall 137 is joined to the cleaning fluid cartridge means 64.

Further, as shown in FIG. 2, valve means 146, 147 are disposed in the inner diameter of each annular disk 143, and preferably each valve means 146, 147 comprsies a check valve. Preferably, valve means 146 is a spring-biased check valve 148, having a sealing member, or sealing disk, 149 biased downwardly toward pump chamber 135, as by a spring member 150 which exerts a biasing force upon a shaft member 151 attached to the sealing disk 149 and secured to the end of the spring member 150 as at 152. This valve means 146 is similar in construction to the safety check valve 86 described in connection with FIG. 1-B. Check valve 147 may preferably be a clapper check valve 153 which is freely moveable within the inner diameter 145 of the annular disk 143 of lower end wall 141. Clapper check valve 153 may have a plurality of wedge members 154 disposed about its outer surface which prevent clapper check valve 153 from passing upwardly into pump chamber 135. Clapper check valve 153 is also provided with a tapered sealing surface 155 disposed about its outer upper circumference. Clapper check valve 153 has a generally circular cross-sectional configuration when viewed from the top of the pump chamber 135. Sealing surface 155 also serves to prevent clapper check valve 153 from falling into cleaning fluid cartridge means 64.

It should be noted that were not lower end wall 141 to be utilized as previously described, an equivalent chamber as shown in FIG. 2 formed by the inner diameter 145 of lower end wall 141 would be provided to cleaning fluid cartridge means 64 in order for clapper valve 153 to properly operate. It should also be noted that different types of check valves could be utilized for valve means 146, 147 as long as the desired sealing effect is provided for the pump chamber 135, as will be hereinafter described in greater detail. It should further be noted that pump means 66, and its pump chamber 135 are preferably formed integrally with cleaning fluid cartridge means 64; however, it should be apparent to one of ordinary skill in the art that a connection, such as a threaded connection, could be provided between pump chamber 135 and cleaning fluid cartridge means 64 to enable the pump means 66, or pump chamber 135, to be removeably secured to the cleaning fluid cartridge means 64.

Pump means 66 is further provided with a nozzle member 160, of any suitable shape, which nozzle member 160 mates with the nozzle receiving cavity 121 of end cap member 111, as previously described in connection with FIGS. 1-A and 4. When the pump means 66 is formed as an integral component with the cleaning fluid cartridge means 64, nozzle member 160 may be provided with a closure tip 161 which is removeably mounted to nozzle member 160 as by a frangible connection at 162, whereby closure tip 161 remains on the pum means 66 and cleaning fluid cartridge means 64 while it is being stored. When it is desired to insert the cleaning fluid cartridge means 64 and pump means 66 into the cleaning system 60, the closure tip 161 is removed from nozzle member 160. Preferably, all of the components of the cleaning fluid cartridge means 64 and pump means 66, previously described, are manufactured of a suitable plastic material; however, valve means 146, 147 could also be manufactured of a suitable corrosion-resistant metallic material.

Still with reference to FIG. 2, when check valve 146 is in its open position, cleaning fluid from within pump chamber 135 may pass through the fluid passageway 138 from cleaning fluid cartrige means 64 and into nozzle member 160, and then into first fluid passageway 81 disposed within handle 61.

Preferably, the inner diameter 145 of one annular disk 143 is larger than the inner diameter 145 of the other annular disk 143. As shown in FIG. 2, the inner diameter 145 of the annular disk 143 which is joined to the cleaning fluid cartridge means 64 is smaller than the inner diameter of the annular disk 143 which forms upper end wall 136. If cleaning system 60 is provided with the safety check valve 86 at the first end 62 of handle 61, it is possible to delete check valve 146 disposed in the upper end of pump chamber 135 in that its sealing action is provided by the safety check valve 86, as will be apparent from the description of the operation of pump means 66 as will be hereinafter described in greater detail.

Still with reference to FIG. 2, the cleaning fluid cartridge means 64 will be described in greater detail. As shown in FIG. 2, cleaning fluid cartridge means 64 is preferably a flexible plastic bottle 165 having a plurality of wall surfaces 166–169 having varying wall thicknesses. For example, wall 166 is thicker than the upper portion of wall 167, whose thickness becomes thinner as wall 167 approaches the intersection between wall 167 and 168. Wall 168 is thinner at its intersection with the lower end of wall 167, and in turn becomes thicker as it approaches its intersection with lower wall 169. Further, wall 169 is thicker than wall 168 and the lower portion of wall 167. It has been found that by varying the wall thicknesses of the walls associated with cleaning fluid cartridge means 64, when cleaning flud cartridge means 64 is a flexible bottle, satisfactory evacuation of the cleaning fluid contained within bottle 165 is obtained upon successive actuations of pump means 66, in that the various wall surfaces of bottle 165 collapse upon one another due to the pumping out of cleaning fluid from bottle 165 from the suction force created by pump means 66 as will be hereinafter described in greater detail. As seen in FIG. 2, bottle 165 generally has the configuration substantially that of a truncated cone. Alternatively, cleaning fluid cartridge means 64 could be a flexible plastic bag which is formed integral with pumpmeans 66, or is secured thereto in any suitable manner. Further, due to the collapsing of the walls of cleaning fluid cartridge means 64, it should be noted that the pump means 66 will pump fluid when the handle is disposed in any angular orientation, in that the operation of pump means 66 does not rely upon gravity forces for successful operation.

With reference now to FIGS. 2 and 5-A, 5-B, 5-C and 1-A, the operation of cleaning system 60 will be described, including a feature of the present invention wherein a means for maintaining the pumping of cleaning fluid from the cleaning fluid cartridge means 64 is obtained after operation of the pump actuation means 67 has ceased movement to apply a force to the pump means 66. With reference to FIGS. 1-A and 5-A, it should be noted that pump support walls 74 are flexibly associated with handle 61, as by flexibly mounting one pump support wall 74 to the interior of housing 69, and flexibly mounting the lower support wall 74 to the interior surface of doot 70. Pump support walls 74 may be provided with the requisite flexibility, to be hereinafter described, as by: manufacturing them of a flexible plastic material; joining the support walls 74 at a plurality of spaced locations along housing 69 and door 70, rather than a continuous integral connection; having the support walls 74 have a reduced wall thickness at their intersection with the interior of housing 69 or door 70; or in any other suitable fashion so that the support walls 74 can flex and not be completely rigid. In general, a force is transmitted to the upper end wall 136 of pump chamber 135, as by depressing trigger member 91, which causes longitudinal movement of end cap member 111 upon nozzle 160, which is turn transmits a force to pump chamber 135 in the direction shown by arrow 170 in FIG. 2. The fluid, whether air or cleaning fluid, contained in pump chamber 135 is then compressed. This compression would cause check valve 147 to assume a sealed position within inner diameter 145 of the annular disk 143 which forms lower end wall 141. The pressure build-up within pump chamber 135 then causes the spring-biased check valve 146 to open, and the fluid contained within pump chamber 135 is pumped through nozzle 160, and into first fluid passageway 81 of handle 61 as previously described, and then out of the first end 62 of handle 61. Upon release of trigger member 91, pump chamber 135 would seek to assume its original configuration as shown in FIG. 2. Check valve 146 would close and a partial vacuum would be created within pump chamber 135 whereby fluid contained in fluid cartridge means 64 would be sucked through check valve 147 into pump chamber 135. Successive actuations of trigger member 91 causes all air, if any, in pump chamber 135 and/or cleaning fluid cartridge means 64 to be expelled, whereupon cleaning fluid fills pump chamber 135 and the first fluid passageway 81 up to the safety check valve 86 in handle 61. Thereafter, each time trigger member 91 is depressed, cleaning fluid will be pumped from, or sucked out of, cleaning fluid cartridge means 64.

By utilizing a flexible and expandable pump chamber 135 which is expanded upon operation of the pump actuation means 67, and utilizing a biased support structure 74 which cooperates with the pump chamber 135, cleaning system 60 will continue to pump cleaning fluid from the pump chamber 135 and outwardly of safety check valve 86 after trigger member 91 has been depressed to its maximum upward travel and/or assumed its second non-operating position previously described in connection with FIG. 1-A. It should be nnoted that the biased support structure 74 biases pump chamber 135 against the force exerted upon the pump chamber 135 by the pump actuation means 67. This means for maintaining the pumping of cleaning fluid from the cleaning fluid cartridge means 64 after operation of the pump actuation means 67 is an important feature of the present invention in that a delayed discharge of cleaning fluid may be provided. In a situation where an operator of the cleaning system 60 is using the cleaning system 60 to clean a bathroom fixture, or other surface desired to be cleaned, the operator is able to move, or depress, the pump actuation means 67, while at the same time moving the handle in a direction across the surface to be cleaned to spray the cleaning fluid onto the desired surface. In other words, the operator does not have to be constantly actuating the cleaning system 60. For example, the operator could depress trigger member 91 whereby during the depression of trigger member 91, cleaning fluid would be expelled from handle 61 during that step. For approximately one second thereafter, cleaning fluid will continue to be pumped from the cleaning system 60, whereby the operator may merely move the handle 61 to direct the cleaning fluid to the surface to be cleaned. In situations wherein an operator is cleaning a multitude of bathroom fixtures, such as a member of a cleaning staff for a hospital, it is a significant advantage to reduce the number of times the operator must depress the trigger member 91.

With reference to FIGS. 5-A through 5-C, the foregoing means for maintaining the pumping of cleaning fluid from the cleaning fluid cartridge means 64 after operation of the pump actuation means 67 has ceased movement to apply a force to the pump means 66, will be described in greater detail. Throughout FIGS. 5-A through 5-C, pump chamber 135, as previously described in connection with FIG. 2, including flexible side wall 137 and upper and lower end walls 136, 141 are shown. Further, the flexible pump support walls 74 are also illustrated. The arrow A of FIG. 5-A illustrates the length of flexible and expandable pump chamber 135 at its rest position when disposed in cleaning system 60 with pump actuation means 67, or trigger member 91 being disposed in the position illustrated in FIG. 1-A. Arrow F represents the pre-load force on pump means 66, or pump chamber 135, as previously described. With reference to FIG. 5-B, the configuration of flexible and expandable pump chamber 135 is illustrated after pump chamber 135 has been compressed due to the transmission of the force from the depression of trigger member 91 which is transmitted to pump chamber 135 via swing arm 110, end cap member 111, and nozzle 160, as previously described. The arrow E denotes the pump chamber stroke length due to the force applied by the pump actuation means 67, and the resulting movement of end cap member 111. Letter B denotes the pump length immediately after actuation of pump actuation means 67, or the depression of trigger member 91. Letter G denotes the expansion of pump chamber 135 due to the flexibility of the flexible side wall 137 of pump chamber 135, as well as the flexing of upper and lower end walls 136 and 141 of pump chamber 135. The expansion is caused by the pressure build-up within pump chamber 135 from the fluid contained within pump chamber 135 and initially confined therein by check valves 146 and 147. It should be noted that immediately after actuation of trigger member 91, the force exerted upon pump chamber 135 has caused the flexing, or movement, of the flexible pump chamber support walls 74, and the pump support flex distance is denoted by letter D.

With reference to FIG. 5-C, the arrow C denotes the pump length when delivery of the cleaning fluid has ceased and the trigger member is still depressed. Arrow E once again represents the pump stroke length supplied by the movement of end cap member 111 from the depression of trigger member 91, and arrow D represents the movement of the flexible pump chamber support walls 74 as they reassume their normal disposition as illustrated in FIG. 5-A. Even though trigger member 91 has ceased to be pressed, cleaning fluid is expelled from the pump chamber 135 because of the forces exerted by the contraction of pump chamber 135, in particular the contraction of the flexible side wall 135, and the biasing force exerted by flexible pump chamber support walls 74 upon pump chamber 135. It is believed that the delay discharge feature of the present invention is thus supplied by energy stored within the pump chamber 135 by the expansion of the flexible side wall 137 and by the spring deflection of the flexible pump chamber support walls 74. It is further believed that another factor affecting the delayed discharge of the cleaning fluid from the cleaning system 60 is the fluid pressure drop across the exit hole, or safety check valve 86 associated with first fluid passageway 81, in that this pressure drop is a function of the viscosity of the cleaning fluid and the diameter of the exit hole of the cleaning system 60.

It is to be understood that the invention is not limited to the exact details of construction, operation, exact materials or embodiment shown and described, as obvious modifications and equivalents will be apparent to one skilled in the art; for example, the flexible and expandable pump chamber could be comprised of a series of pump chambers rather than a single pump chamber; or the pump chamber could be actuated by a pulling motion rather than a pushing motion. Accordingly, the invention is therefore to be limited only by the scope of the appended claims.

We claim:

1. A cleaning wand comprising:

an elongate housing having a cavity therein adapted to receive a cleaning fluid cartridge;

a surface cleaning means connected to said housing; a finger trigger pivotally connected to said housing within a slot in said housing; a movable linkage pumping mechanism within said cavity of said housing comprising a pivotal swing arm and an end cap member, said pivotal swing arm being in operative engagement with said end cap member and having a camming surface for sliding engagement with an inner surface of said trigger, whereby upon depression of said trigger said camming surface slides on said inner surface of said trigger and said swing arm pivots, thereby causing said end cap member to move toward a rear of said housing opposite said surface cleaning means, said end cap member being adapted to compress said cartridge upon movement of said end cap member toward said rear of said housing, said linkage pumping mechanism thereby permitting translation of movement of said pivotal trigger in a first direction upon depression thereof into movement of said end cap member in a second direction generally transverse to said direction of movement of said trigger; and a tube disposed within said cavity of said housing for permitting fluid communication between said cartridge and a discharge passage in said housing, said linkage pumping mechanism being adapted to effectuate compression of said cartridge to discharge cleaning fluid from said cartridge through said tube and outward from said housing through said discharge passage upon depression of said trigger.

2. A cleaning wand as recited in claim 1, wherein said housing has a movable door allowing access to said cavity within said housing.

3. A cleaning wand as recited in claim 1 wherein said end cap member is pivotal about a first shaft connected to said swing arm and said swing arm is pivotal about a second shaft connected to said housing.

4. A cleaning wand as recited in claim 1 wherein said end cap member further comprises a pressure transmitting member having a nozzle receiving cavity therein adapted to receive a nozzle of said cartridge therein and wherein said end cap member further comprises means for connecting said tube to said end cap member.

5. A cleaning wand comprising:

an elongate housing having a first end, a second end, and a cavity therein adapted to receive a cleaning fluid cartridge therein at said second end of said housing, said cartridge including a resilient pump chamber;

a surface cleaning means connected to said housing at said first end thereof;

a finger trigger pivotally connected to said housing within a slot in said housing;

a movable linkage pumping mechanism within said cavity of said housing comprising a pivotal swing arm and an end cap member, said pivotal swing arm being in operative engagement with said end cap member and having a camming surface for sliding engagement with an inner surface of said trigger, whereby upon depression of said trigger said camming surface slides on said inner surface of said trigger and said swing arm pivots, thereby causing said end cap member to move toward a rear of said housing opposite said surface cleaning means, said end cap member being adapted to compress said pump chamber upon movement of said end cap member toward said rear of said housing, said linkage pumping mechanism thereby permitting translation of movement of said pivotal trigger in a first direction upon depression thereof into movement of said end cap member in a second direction generally transverse to said direction of movement of said trigger; and a tube disposed within said cavity of said housing, said tube having a first end proximate said first end of said housing and a second end connected to said linkage pumping mechanism, said tube permitting fluid communication between said pump chamber and a discharge passage in said housing proximate said first end of said tube, said linkage pumping mechanism being adapted to effectuate compression of said pump chamber to discharge cleaning fluid from said pump chamber through said tube and outward from said housing through said discharge passage upon depression of said trigger.

* * * * *